United States Patent [19]

Andersen et al.

[11] Patent Number: 4,684,129

[45] Date of Patent: Aug. 4, 1987

[54] BASKETBALL STANDARD AND ADJUSTABLE SUPPORT STRUT THEREFOR

[75] Inventors: Robert L. Andersen, Provo, Utah; Richie D. Andersen, Mesa, Ariz.

[73] Assignee: Andersen Manufacturing, Inc., Provo, Utah

[21] Appl. No.: 843,245

[22] Filed: Mar. 24, 1986

[51] Int. Cl.[4] ..... A63B 63/08

[52] U.S. Cl. ..... 273/1.5 R; 248/354.7; 403/105

[58] Field of Search ..... 273/1.5 R; 248/407–409, 284, 286, 351, 354.1, 354.6, 354.7, 653; 403/104, 105

[56] References Cited

U.S. PATENT DOCUMENTS

| | | | |
|---|---|---|---|
| 3,161,395 | 12/1964 | Carter | 248/354.7 |
| 3,367,689 | 2/1968 | McCarthy | 248/354.6 X |
| 3,697,103 | 10/1972 | Mostyn | 248/407 X |
| 4,289,292 | 9/1981 | Konnoman | 248/407 X |
| 4,330,101 | 5/1982 | Anderson | 248/284 |
| 4,456,298 | 6/1984 | Gottstein | 248/423 X |

FOREIGN PATENT DOCUMENTS

| | | | |
|---|---|---|---|
| 777416 | 11/1934 | France | 248/354.6 |

*Primary Examiner*—Paul E. Shapiro

*Attorney, Agent, or Firm*—M. Ralph Shaffer

[57] ABSTRACT

Basketball standard and adjustable support strut therefor, wherein backboard can be raised and lowered, as needed, to achieve the correct or chosen height of the backboard above a playing surface. The strut structure incorporated in or added to the basketball standard structure is self-adjusting and self-locking upon the user simply moving vertically the basketball backboard. The strut includes a pair of telescoping tubular members provided with an appropriately contoured side-aperture and a pin mechanism riding in such aperture such that the strut can be lengthened a maximum amount, thus lowering the backboard; subsequently, the backboard is raised a selected distance such that the pin mechanism engages a chosen detent recess. Camming surfaces are provided with the pin mechanism so as to facilitate appropriate pin movement. The strut construction can also be employed in other constructions as may be desired.

14 Claims, 9 Drawing Figures

BASKETBALL STANDARD AND ADJUSTABLE SUPPORT STRUT THEREFOR

FIELD OF INVENTION

The present invention relates to basketball standards, adjustable struts for incorporation therein, as well as in other contexts, and more particularly, incorporation of an adjustable strut which is constructed so that the same may be adjusted remotely and automatically, without the user touching the strut proper.

DESCRIPTION OF PRIOR ART

The inventors are aware of certain prior constructions in connection with basketball standards and length-adjustable struts, these being shown in U.S. Pat. Nos. 3,802,702 and 4,330,101. The inventors are likewise aware that certain other patents relate in general terms to adjustable basketball standards, struts, and the like, in connection with the U.S. and foreign patents listed in U.S. Pat. No. 4,330,101 at the first column thereof. Certain advantages are found in the present invention, as to remote actuation of an adjustable strut, which are not found in the prior art. This includes provision for a floating pin mechanism designed to cooperate with a pair of telescoping tubes in a manner such as to provide for essentially free extension of the strut and also dogged or detented retraction whereby a given detent slot or recess can be employed to position the strut and thus predetermine the length of the strut for any given height of basketball standard desired. No other art is known that teaches this concept, either as to basketball standards in particular, or strut employing structures in general.

BRIEF DESCRIPTION OF PRESENT INVENTION

According to the present invention the strut structure incorporates a pair of telescoping tubes each being provided with suitably contoured sidewall apertures designed to accommodate appropriately a pin mechanism which is carried by a follower or plug within the interior of the inside tube. The pin mechanism includes a pin detent that proceeds through both sidewall apertures of the inner and outer tubes that are appropriately contoured so that the pin can ride downwardly, free of obstruction, when the strut is lengthened; however, when the strut combination is to be shortened, then the detent pin of the mechanism will ride up and will successively engage a series of appropriately slanted or canted teeth and, when the appropriate strut length and pinpositioning have been achieved, the user will simply release the previously raised backboard, for example, such that the pin will nestle into the detent recess selected. Sidewall apertures are suitably contoured to provide the effect desired. A counterbalancing spring is preferably used between the inner and outer tubes so as to facilitate the raising of the basketball standard; additionally, a spring is coupled between the rearmost end of the inner tubular member and the plug or pin mechanism, whereby to allow a rearward spring biasing of the plug and, simultaneously, enablement of rotational displacement and, indeed, a slight torsion spring effect, relative to the plug or follower that carries the pin. The latter spring aids in appropriately positioning the pin during its movement cycle.

OBJECTS

Accordingly, a principal object of the present invention is to provide for a new and improved adjustable strut mechanism.

An additional object is to provide an improved, adjustable basketball standard incorporating an adjustable strut such that the mere raising or lowering of the standard will appropriately alter the length of the strut so that appropriate, preselected support can be had for the standard.

An additional object is to provide a strut formed of a pair of telescoping tubular members, the same having appropriate sidewall apertures and a pin mechanism so as to provide free adjustment in one direction but stepped adjustment in another direction of relative movement, and this automatically, even though the adjustment is made from a point remote to the strut proper.

BRIEF DESCRIPTION OF THE DRAWINGS

The present invention may best be understood by reference to the following description, taken in connection with the accompanying drawings in which.

DESCRIPTION OF PREFERRED EMBODIMENTS

Figures 1, 2, 3, 4, 5, 6, 7, 8, 9:
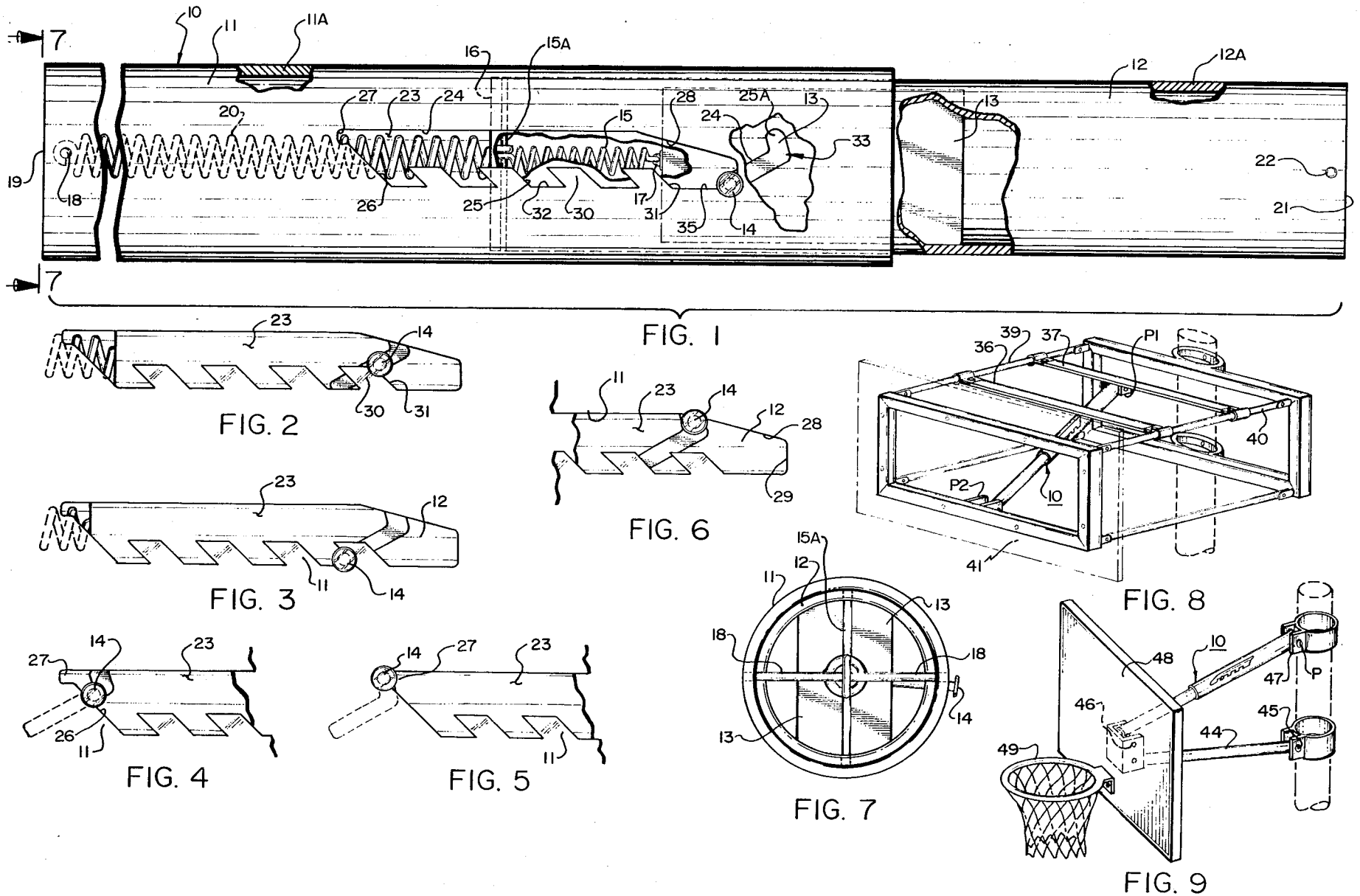
FIG. 1 is a side elevation partially broken away, of a strut structure in a preferred embodiment of the present invention.
FIGS. 2–6 are fragmentary details of the central portion of FIG. 1, but illustrating the detent pin in the construction as being in a variety of locations.
FIG. 7 is an end view of the strut structure of the present invention and is taken along the line 7—7 in FIG. 1.
FIG. 8 is a perspective view in schematic form of a basketball standard incorporating the strut of the present invention wherein the strut is coupled between the backboard and a brace of the support structure employed.
FIG. 9 is similar to FIG. 8 but illustrates alternate means capable of articulated or pivotal movement at opposite ends; whereby a backboard is supported from stationary structure; the strut mechanism of the invention is included so that the backboard may be maintained in a vertical plane and also so that the backboard can be positioned at an appropriate vertical height.

In FIG. 1 strut 10 includes a first, elongate outer tubular member 11 and also a second, elongate inner tubular member 12. These tubular members are shown as round but can be any other shape as having a square or rectangular cross-section, by way of example. Disposed in the inner tubular member 12 is a follower member 13 which can take the form of simply a plug that is translatable along its axis and also rotationally displaceable about the same axis. Follower member 13 includes an outwardly extending headed detent pin 14. Where the detent pin is articulative connected to follower member 13, then no rotational displacement of the follower member or plug will be needed. In the embodiment shown, however, the detent pin protrudes radially outwardly and, accordingly, because of its circuitous travel path as hereinafter explained, the follower member will have to be rotationally displaceable. This is accomplished through employment of a spring 15 which preferably comprises a coil spring that is anchored between the pin 15A, affixed to the end 16 of inner tubular member 12, and a spring retainer 17 that is simply secured to the end of the plug or follower member 13. Pin 18 is secured to and through the left or rearmost end 19 of outer tubular member 11. A counterbalancing tension spring 20 is secured between such pin and also the pin 15A. Accordingly, spring 20 tends to urge telescoping inner member 12 to the left, within outer tubular member 11, thus tending to counterbalance the weight of the backboard which would be secured to end 21, by pin 22, of inner tubular member 12. Accordingly, one lifting any backboard attachment to end 21 will be aided by spring 20. The purpose of spring 15, however, is to tend to urge the block or follower member 13 to the left, and likewise, to assist in the placement of detent pin 14. Tubular member 11 will of course have sidewall 11A, whereas inner tubular member 12 will have sidewall 12A. Disposed in sidewall 11A will be contoured, sidewall longitudinal slot 23, the same having a straight or essentially straight upper surface 24, a toothed surface 25, an inclined camming surface 26, a pin positioning recess 27, a forward slanted declining camming surface 28, and end surface 29. Surface 25 is formed by a series of rearwardly canted teeth 30 having camming surfaces 31 and a series of detent recesses 32. An L-configured camming slot 33 is provided, with the base of the L comprising a pin or slot portion 25A that will come in alignment with pin positionihg recess 27. Detent pin 14 is disposed in recess 27.

FIG. 1 illustrates the condition wherein the detent pin 14 is at the position shown, namely, when the inner telescoping tubular member 12 is withdrawn to the right to a maximum extent relative to tubular member 11. Accordingly, with the top or left hand end 19 of the outer tubular member 11 being secured to a support member and pin 22 being secured to a suitable journal affixed to backboard structure, then the FIG. 1 condition illustrates the situation wherein the backboard is at its lowermost level, the strut 10 being fully extended.

The structure of FIG. 1 and of FIGS. 5 and 6, operates as follows: When the user desires to elevate the backboard slightly then he will simply lift upwardly on the lower edge of such backboard so as to advance the detent pin upwardly along surface 31 of respective tooth 30 so that the same will proceed over the first tooth, or additional teeth if desired, and nestle into an appropriate recess slot 32 as shown in FIG. 3. Of course, any of the other recess slots might be selected for disposition of the pin. It is noted that during this elevation of the backboard, the inner tubular member 12 will move the left, i.e., toward a more enclosed position within outer tubular member 11; correspondingly, the plug or follower member will likewise be moved to the left in the L-shaped slot, as seen.

Where the user intends a descent of the backboard, then he advances the inner tubular member 12 upwardly, i.e., to the left in FIG. 1, until the detent pin engages the upwardly angulated or inclined surface 26 as seen in FIG. 4. The inner tubular member 12 is further advanced such that the pin 14 now proceeds into pin positioning recess 27. This is facilitated by the inclusion of the recess-slot area 25 in the sidewall of inner tubular member 12, the latter coming in registry with recess 27 in FIG. 5 at the pin position shown in FIG. 5. It is the inclusion of this slot portion 25 comprising the foot of the "L" which serves to advance detent pin 14 to the right in FIG. 5 until the same contacts the declining slot surface 28 in FIG. 6. Entire advance of the pin along surface 24 in FIG. 1, to the right as illustrated in FIG. 6, is caused by the retention of the pin within slot portion 25 of slot 33. Such declining surface 22 tends to bring the pin around out of slot portion 25 so that the pin enters the principal portion of slot 33, the pin thereby descending downwardly so as to engage surface 35 in FIG. 1.

Accordingly, and in summary, the user can simply advance the backboard of the basketball standard upwardly so that the pin 14 engages the recesses at 27 and at 25, the two recesses being aligned at the uppermost position of inner tubular member 12, i.e., at the upper left slot portion in FIG. 1. At this point, the user can simply lower the backboard all the way down until the inner tubular member is simply extended, the condition shown in FIG. 1. Subsequently, the user will lift partway the backboard so that the detent pin falls in the desired detent recess 32. The canted nature of the teeth allow for a firm "hooking" of the pin at the desired recess and, in addition, permits a cammed action against the pin when the backboard is further raised.

FIG. 7 illustrates the end view of the structure of FIG. 1, illustrating the concentric tubular members and also the interior plug or follower member.

FIG. 8 illustrates the schematic form that a basketball standard similar to that shown in Anderson U.S. Pat. No. 4,330,101, which is fully incorporated by way of reference herein. This patent teaches side braces forming congruent movable parallelograms which keep the backboard and its frame vertical to the ground plane whatever the height of the backboard and its basket. Upper cross braces can be removed and replaced, for example, by parallel cross braces 36 and 37 that are attached to parallelogram rods 39 and 40, the same supporting backboard 41. The entire frame 42 will be conventional and will follow generally that shown in U.S. Pat. No. 4,330,101. Another type of configuration is possible, as seen in FIG. 9, wherein the backboard 48 is supported by a principal arm 44 having articulated journals 45 and 46 that are secured to support 47 and backboard 48, the latter being provided with basket 49. The strut of the present invention at 10 is shown in this figure as well. In such a construction the distance between the detent teeth of FIG. 1 will be substantially lessened; additionally, the dimension will have to take account of the fact that in addition to the successive height dispositions intended for the backboard, the latter also must be normal, i.e., vertical, relative to the playing floor. Suitable pins, bosses, or other journalling means can be employed for the adjustable strut 10 in FIG. 9. In the case of FIG. 8 similar articulated joint means or pivot means can be employed at P1 and P2.

Whatever the supporting structure or means by which the backboard and its basket are supported from fixed structure, the subject telescoping brace structure as shown at 10 in FIG. 1 ideally serves to facilitate adjustment of height of the backboard, and this without the user even touching the strut. Rather, he accomplishes the same by merely pushing upwardly on the lower edge of the backboard with a suitable pole or tool until the correct height is achieved and the pin latched in the appropriate pin detent recess. If the user needs to lower the backboard, then he simply raises it first, allowing the pin to lock in recess portion 25 as before explained, permitting the strut to be fully extended and the backboard lowered.

What is provided therefor is a new and improved adjustable strut to be employed in a variety of contexts and, particularly, in basketball backboard apparatus installations.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. An adjustable strut including, in combination: a first, elongate outer tubular member; a second, elongate inner tubular member telescopingly disposed within and extensible beyond said first member and provided with a sidewall camming slot, said first and second members each having circumferential sidewalls; a follower member having a side-outwardly directed detent pin disposed in and extending outwardly beyond said camming slot, said follower member being slidably disposed for longitudinal movement within said second member, said first member having a contoured sidewall longitudinal slot provided, on one edge thereof, with a series of mutually-spaced detent slots defined by a series of rearwardly canted teeth, a rearward slot portion having an upwardly sloping camming surface terminating in a pin-positioning recess, and a forward slot portion having an upper, downwardly sloping camming surface, said detent pin projecting in said contoured slot and coacting with the contoured periphery thereof, said camming slot of said second member being essentially L-shaped and having an L-foot selectively registering with said pin positioning recess and constructed as a detent carrier slot portion for said detent pin during longitudinal forward travel, said downwardly sloping camming surface being constructed to move said pin out of engagement with said detent carrier slot portion, whereby to position said detent pin for selective engagement with said mutually-spaced detent recesses, said second member having a spring retainer; and coil spring means coupled to and between said spring retainer of said second member and said follower.

2. The structure of claim 1 wherein second coil spring means is coupled to and between said first and second members.

3. The structure of claim 1 wherein said follower comprises a slidable plug member.

4. The structure of claim 1 wherein said follower is constructed for axially rotational displacement within said second member.

5. The structure of claim 1 wherein second coil spring means is axially connected between said first member and said follower member.

6. A basketball standard including, in combination: a backboard having front and back surfaces and provided with a hoop projecting forwardly from said front surface; a support; means coupled to and between said support and said backboard, at the latter's back surface, for vertically-adjustably securing said backboard to said support; and an adjustable strut, articulatively secured to and between said backboard and one of said means and said support, for positioning said backboard at a pre-selected height, said adjustable strut including, in combination: a first, elongate outer tublar member; a second, elongate inner tubular member telescopingly disposed within and extensible beyond said first member and provided with a sidewall camming slot; said first and second members each having circumferential sidewalls; a follower member having a side-outwardly directed detent pin disposed in and extending outwardly beyond said camming slot, said follower member being slidably disposed for longitudinal movement within said second member, said first member having a contoured sidewall longitudinal slot provided, on one edge thereof, with a series of mutually-spaced detent slots defined by a series of teeth rearwardly canted, a rearward slot portion having an upwardly sloping camming surface terminating in a pin positioning recess, and a forward slot portion having an upper, downwardly sloping camming surface, said detent pin projecting in said contoured slot and coacting with the contoured periphery thereof, said camming slot of said second member being essentially L-shaped and having an L-foot selectively registering with said pin-positioning of recess and constructed as a detent carrier slot portion for said detent pin during longitudinal forward-travel, said downwardly sloping camming surface being constructed to move said pin out of engagement with said detent carrier slot portion, whereby to position said detent pin for selective engagement with said mutually-spaced detent recesses, said second member having a spring retainer; and coil spring means coupled to and between said spring retainer of said second member and said follower.

7. The structure of claim 6 wherein second coil spring means is coupled to and between said first and second members.

8. The structure of claim 6 wherein said follower comprises a slidable plug member.

9. The structure of claim 6 wherein said follower is constructed for axially rotational displacement within said second member.

10. The structure of claim 6 wherein second coil spring means is axially connected between said first member and said follower member.

11. A basketball standard including, in combination: a backboard provided with a hoop; first means coupled to said backboard or adjustably securing said backboard to external support structure; and second means coupled to said backboard for adjusting and releasably fixing the height of said backboard relative to a lower, external playing surface, said second means comprising (1) a pair of telescoping tubes each having registering, camming configured sidewall apertures, and (2) pin means projecting through said sidewall apertures for selectively determining the combined extension of said tubes, said sidewall aperture of the outermost one of said tubes having pin camming surfaces and mutually-spaced, rearwardly angulated, detent recesses disposed therebetween.

12. The structure of claim 11 wherein said pin means includes a follower member disposed within the innermost one of said tubes and a pin mounted to said follower member and projecting through said sidewall apertures.

13. The structure of claim 12 wherein said follower member is provided with spring means coupled to the innermost one of said tubes.

14. The structure of claim 12 wherein the outermost one of said tubes includes spring means coupled to the innermost one of said tubes.

* * * * *